US005257764A

United States Patent [19]

Spaulding

[11] Patent Number: 5,257,764

[45] Date of Patent: Nov. 2, 1993

[54] SCREED RAIL SUPPORT APPARATUS

[76] Inventor: Roy L. Spaulding, 8630 Gaines Ave., Orangevalle, Calif. 95662

[21] Appl. No.: 732,579

[22] Filed: Jul. 18, 1991

[51] Int. Cl.[5] ..... A47G 29/00

[52] U.S. Cl. ..... 248/125; 248/132; 404/96

[58] Field of Search ..... 248/125, 132, 406.1, 248/423, 186, 176, 177; 404/96, 86, 103; 52/741

[56] References Cited

U.S. PATENT DOCUMENTS

| | | | |
|---|---|---|---|
| 1,169,464 | 1/1916 | Cornelius | 404/120 |
| 3,005,387 | 10/1961 | Heltzel et al. | 94/45 |
| 3,404,611 | 10/1968 | Wilson | 404/120 |
| 4,115,976 | 9/1978 | Roher | 404/119 X |
| 4,321,024 | 3/1982 | Terraillon | 425/311 |
| 4,437,828 | 3/1984 | Egger | 425/458 |
| 4,507,015 | 2/1985 | Furukawa et al. | 404/103 |
| 4,621,944 | 11/1986 | Jordense | 404/96 X |
| 4,702,640 | 10/1987 | Allen | 404/96 X |
| 4,818,140 | 4/1989 | Carlson | 404/96 X |
| 4,892,439 | 1/1990 | Kiefer | 404/119 |
| 4,913,582 | 4/1990 | Barrett | 404/119 |
| 4,934,643 | 6/1990 | Militano, Jr. | 248/124 |
| 4,966,490 | 10/1990 | Hodson | 404/103 |
| 5,059,062 | 10/1991 | Bresnahan | 404/96 X |

OTHER PUBLICATIONS

Advertisement sheet for "Speed Screed"—undated Speed Screed Systems Corporation.

Catalog sheet p. 69—Burke Adjustable Screed Supports The Burke Company.

*Primary Examiner*—Ramon O. Ramirez

*Attorney, Agent, or Firm*—John P. O'Banion

[57] ABSTRACT

A concrete screed rail support apparatus which includes a saddle having a channel with open ends and an open top for accommodating a screed rail, and a pair of arms each connected at its proximal end portion to the saddle. Each arm extends outwardly from the saddle and connects to a leg at the distal end portion. Each leg extends toward the concrete pour surface, and the length of each leg between the pour surface and its connection to the distal end portion of the arms is adjustable. Locking mechanisms are provided to fix the position of the legs once adjusted and to lock the screed rail to the saddle. Pads can be used between the pour surface and the legs for stability and to prevent damage to vapor barriers or waterproofing membranes.

20 Claims, 5 Drawing Sheets

SCREED RAIL SUPPORT APPARATUS

BACKGROUND OF THE INVENTION

1. Field of the Invention

This invention pertains generally to leveling poured concrete and more particularly to an adjustable apparatus for supporting screed rails used in connection with leveling concrete.

2. Description of the Background Art

In order to provide smooth, uniform surfaces, freshly poured concrete must normally be spread over the area of the pour and "screeded" into place. A leveling device commonly known as a "screed" is drawn over the freshly poured concrete to ensure that a uniform layer results. Hand screeding, which is common in the industry, is a labor intensive task. When pouring and leveling concrete slabs directly on the ground, forms are used to frame the area of the pour. Typically the ground is uneven, thus making it difficult to obtain perfectly flat slabs. Wood forms, which are commonly held in place with stakes and nails, deteriorate with use over time. Similar problems are encountered when pouring concrete on metal or wood decks, and when pouring tilt-up wall panels. As a result, several approaches to concrete forming and leveling have been developed in an attempt to economically place concrete.

Examples of devices which move along rails or tracks for placing and leveling concrete can be found in U.S. Pat. No. 4,507,015 issued to Furukawa et al. on Mar. 26, 1985, which discloses a box-like screed apparatus which is guided by tracks or rails; U.S. Pat. No. 3,005,387 issued to Heltzel et al. on Oct. 24, 1971, which discloses a concrete grooving tool which has a guide bar which fits over a guide rail for accurately positioning the groove; and U.S. Pat. No. 3,404,611 issued to Wilson on Oct. 8, 1968, which discloses a reciprocating belt apparatus for finishing concrete which moves along rails supported from their underside by threaded jack members which can be positioned to the proper height. Those patents, however, do not present solutions for the positioning and placement of screed rails for hand finishing in areas where the devices disclosed cannot be used.

Examples of hand operated screed rail and rail support devices can be found in U.S. Pat. No. 4,913,582 issued to Barrett on Apr. 3, 1990, which discloses a screed chair having a base plate, a pipe, and at least one threaded vertical support which holds a horizontal saddle onto which a screed pipe is rested; U.S. Pat. No. 4,115,976 issued to Rohrer on Sep. 26, 1978, which discloses a screed support and method of screeding cement which comprises screed rails, and screed rail supports which are left in place after the concrete is poured but removed before the concrete hardens; U.S. Pat. No. 4,321,024 issued to Terraillon on Mar. 23, 1982, which discloses metal stands which rest on the ground and support removable metal forms; U.S. Pat. No. 1,169,464 issued to Cornelius on Jan. 25, 1916, which discloses portable forms and supports for molding concrete or cement curbing; U.S. Pat. No. 4,437,828 issued to Egger on Mar. 20, 1984, which discloses a screed bar support saddle which has vertical adjustable legs; and U.S. Pat. No. 4,934,643 issued to Militano on Jun. 19, 1990, which discloses a support for concrete screed rails which has an upright stake or post and uses a sleeve adjustably mounted on the post for movement along the post. Those patents, however, disclose devices which suffer from several disadvantages. For example, when pouring concrete on a steel or otherwise impenetrable deck, with some of the devices disclosed it would be necessary to drill holes in the deck material for placement of the forms or screed rail supports. Punctures in a waterproof membrane often used with concrete slabs can also occur with some of the devices disclosed. Also, it can be quite difficult to obtain a transit sight or to position a string line at the finished slab height with many of the devices heretofore developed. Many of the devices heretofore developed are labor intensive, are costly to set-up and use, and do not provide for easy relocation and re-use of the screed rails after a section of concrete is poured and leveled.

The present invention overcomes the aforementioned as well as other deficiencies in the devices heretofore developed and provides a screed rail support mechanism which can be easily placed and removed from a graded surface in conjunction with the pouring of concrete.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention renders all other manual screed accessories obsolete, and replaces screw stakes, wire chairs, pointed stakes, base plates and other costly, difficult to use screed accessories. In general terms, the mechanism of the present invention employs a saddle which accommodates at least one screed rail and is capable of supporting a pair of screed rails in end to end disposition. The saddle is constructed with an open channel to allow the screed rails to be easily placed and removed from the saddle. Locking handles attached to lock bolts extending through the side walls of the saddle and into the channel are provided to fasten the screed rails to the saddle. The engagement ends of the lock bolts are flared to prevent the lock bolts from being completely backed out and lost on the job site.

A pair of arms are attached to the side walls of the saddle and extend outwardly therefrom. Each arm is attached to the saddle in such a position that the bottom of the arm will be positioned at the finished slab height so that a string line can be run beneath the arms for sighting. This is accomplished by attaching the arm to the saddle such that the bottom of the arm is at the same elevation as the inside bottom of the channel in the saddle.

A steel reinforced leg is attached to each of the distal end portions of each arm and extends to the pour surface which may be earth, steel, concrete or the like. The lateral separation between the legs is approximately twelve inches (30.48 centimeters) so that the legs will provide stable support on corrugated metal surfaces, regardless of whether the leg is resting on the top or bottom of the ridge. Each of the legs also includes a disposable pad which provides a platform for the legs above the pour surface and which are ideally suited for slabs on grade or other unstable surfaces such as sand. Additionally, the platforms prevent damage from occurring to waterproofing or vapor barrier materials.

Each arm also includes a means for adjusting the length of the leg between the connection of the leg to the end of the arm and the ground. Such adjustment means typically comprises threads on the leg which engage a threaded receptacle in the arm. A handle is provided to turn the leg to increase or decrease the distance between the arm and the pour surface, and a locking nut is provided to fix the position of the leg so that it does not move once adjusted.

Four of the mechanisms of the present invention may be used in cooperation to support a pair of screed rails in approximate parallel configuration. A screed may then be drawn across the freshly poured concrete using the pair of screed rails as a guide. Another pair of screed rails may be employed at either end of the first pair by the use of two more mechanisms of the present invention, making a total of six. By this method, another concrete section may be poured adjacent to the first section. The pair of support mechanisms found on the end of the first pair of screed rails furthest from the second pair of rails may then be "leapfrogged" into position for a second pour, reusing the first pair of screed rails. In addition, adjacent pours may be made laterally to the first pour using another pair of the support mechanism.

Installation of the support mechanism of the present invention can be accomplished by one person in approximately fifteen minutes, thereby eliminating the need for a pre-setup crew. This can be contrasted with the use of conventional screed rail accessories which normally require three persons approximately six hours to set up.

The saddle will accommodate standard 2×4's or aluminum box channels. Using a laser level or string line as a guide, the leveling handle is adjusted until the legs ar the correct height. Since the screed rod will always be controlled by the adjustable rail supports, the need to wet screed is eliminated. Furthermore, the legs can be readjusted on either side of the saddle as concrete is being placed to correct for deflection on suspended floors.

An object of the invention is to provide a screed rail support mechanism which rests on the grade without penetrating the same.

Another object of the invention is to provide a screed rail support mechanism which can be recovered for reuse.

Another object of the invention is to provide a screed rail support mechanism which is adjustable in height with relation to the pour surface.

Another object of the invention is to provide a screed rail support mechanism which is adjustable in tilt in relation to the pour surface.

Another object of the invention is to provide a screed rail support mechanism which is capable of supporting a pair of screed rails in end-to-end abutment.

Another object of the invention is to provide a screed r il support mechanism which permits easy placement and removal of the screed rail.

Another object of the invention is to provide a screed rail support mechanism which is capable of locking a screed rail into position.

Another object of the invention is eliminate the need for wet screeding.

Another object of the invention is to support screed rails without penetrating vapor barrier or waterproofing materials.

Another object of the invention is to support screed rails at a uniform height on uneven or unstable surfaces.

Another object of the invention is to provide a screed rail support mechanism which does not interfere with leveling string lines.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the screed rail support mechanism 10 generally shown in FIG. 1 through FIG. 4. It will be appreciated that the apparatus may vary as to configuration and as to details of the parts without departing from the basic concepts as disclosed herein.

Figure 1:
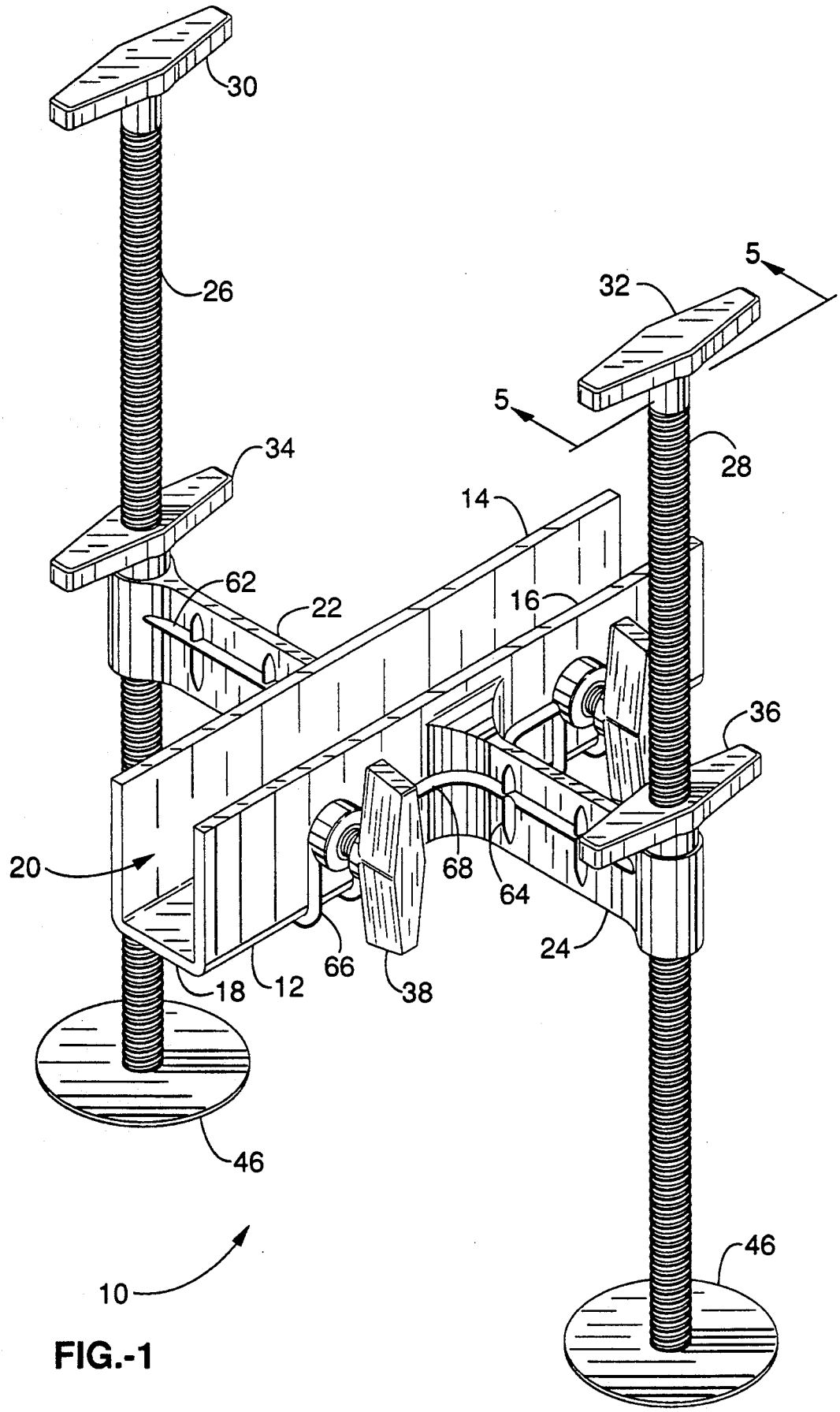
FIG. 1 is a perspective view of the mechanism of the present invention.
Figure 3:
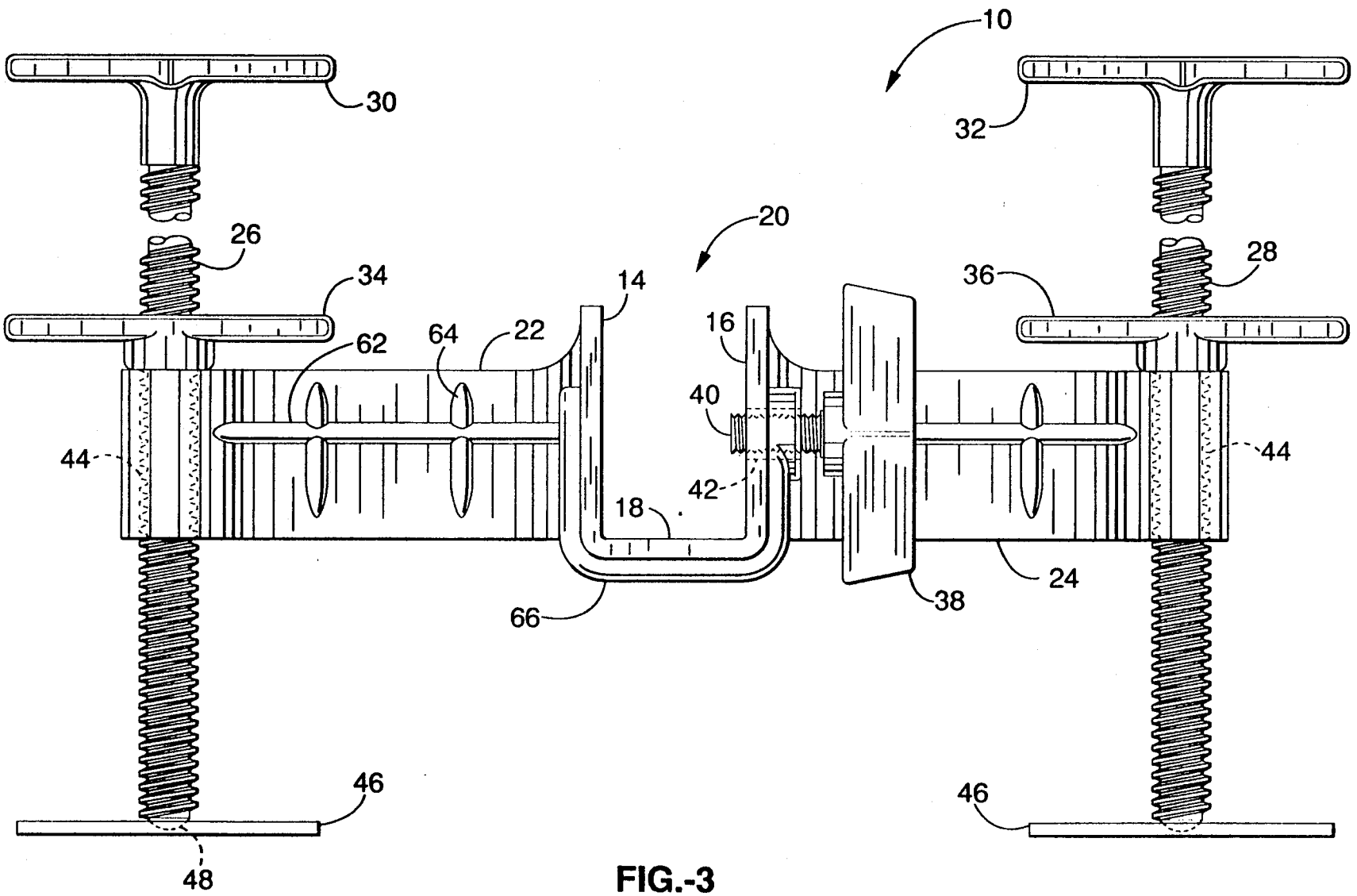
FIG. 3 is an end elevation view of the mechanism shown in FIG. 1.

Referring to FIG. 1 and FIG. 3, screed rail support mechanism 10 includes a saddle 12 having a bottom wall 18 and opposing side walls 14, 16 which are oriented substantially perpendicular to bottom wall 18. This configuration forms a channel 20 with an open top and open ends of sufficient size for accommodating a standard 2×4 wooden screed rail, an aluminum box channel screed rail, or the like.

Connected to side walls 14, 16 are arms 22, 24 respectively. Preferably, saddle 12 and arms 22, 24 are formed of plastic materials or the like, and the proximal ends of arms 22, 24 are integrally formed with saddle 12. However, any rigid form of attachment would be acceptable.

The proximal ends of arms 22, 24 are connected to side walls 14, 16 at a position which places the bottoms of arms 22, 24 at the same elevation as the surface of bottom wall 18 which is inside channel 20. Because the bottom of the screed rail will rest on the surface of bottom wall 18 which is inside channel 20, this permits the bottoms of arms 22, 24 to establish the elevation of the finished concrete. In this manner, a string line can be used to set the finished concrete elevation by adjusting the length of legs 26, 28 until the bottoms of arms 22, 24 are sitting on the string line thereby establishing the proper height of saddle 1 and the screed rail which rests in channel 20.

Figure 5:
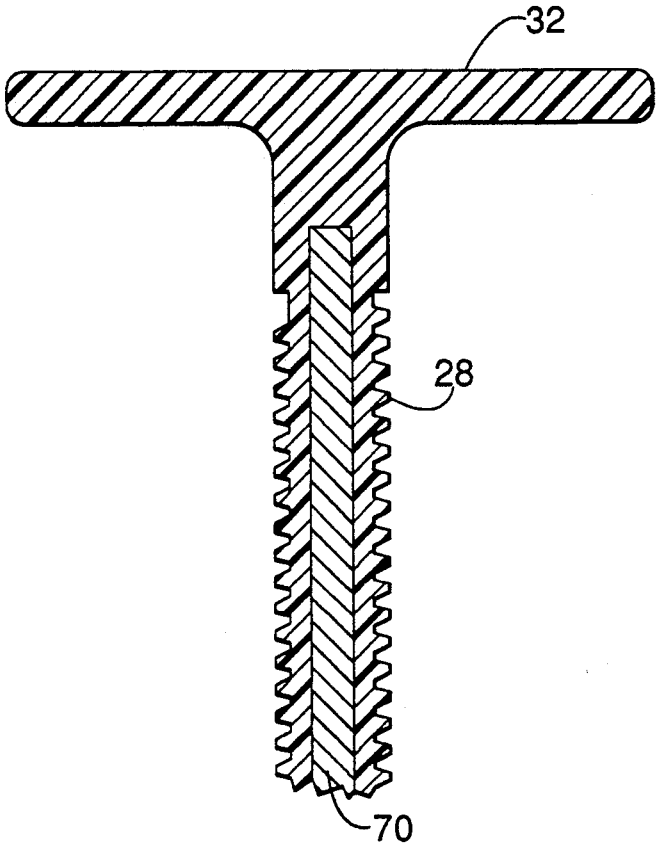
FIG. 5 is a cross-section view of a leg and handle assembly shown in FIG. 1 taken through line 5—5.

The distal ends of arms 22, 24 include internally threaded receptacles 44 which rotatably engage threads on the outer surfaces of legs 26, ,28. Handles 30, 32 facilitate the turning of referring also to FIG. 5, legs 26, 28 in relation to receptacles 44. Legs 26, 28 extend to the concrete pour surface and are preferably made of concrete resistent plastic or the like encapsulating a steel or otherwise rigid rod 70 for strength.

Lock handles 34, 36 are internally threaded and rotate over legs 26, 28 respectively. Once the position of legs 26, 28 is established, lock handles 34, 36 are rotated until they abut the distal ends of arms 22, 24. This will prevent inadvertent rotation of legs 26, 28 during the concrete pour and permit the proper elevation to be maintained.

Referring to FIG. 3, pads 46 support legs 26, 28 on unstable or irregular surfaces and are easily removable. Preferably pads 46 are flat, rounded discs with a receptacle 48 centrally placed therein which will accept the end of the leg without frictional engagement. When legs 26, 28 are removed from the concrete after it is poured, pads 46 are left behind. Pads 46 also prevent legs 26, 28 from penetrating and damaging vapor barrier or waterproofing membranes often used in connection with concrete slabs poured on grade. Note also that the lateral spacing between legs 26, 28 is preferable twelve inches (30.48 centimeters) to permit legs 26, 28 to stably rest on corrugated metal without the use of pads 46. Most sheets of corrugated metal have ridges and valleys which use this spacing and, therefore, legs 26, 28 will provide stable support whether resting on the top of the ridge or the bottom of the valley.

Figure 2:
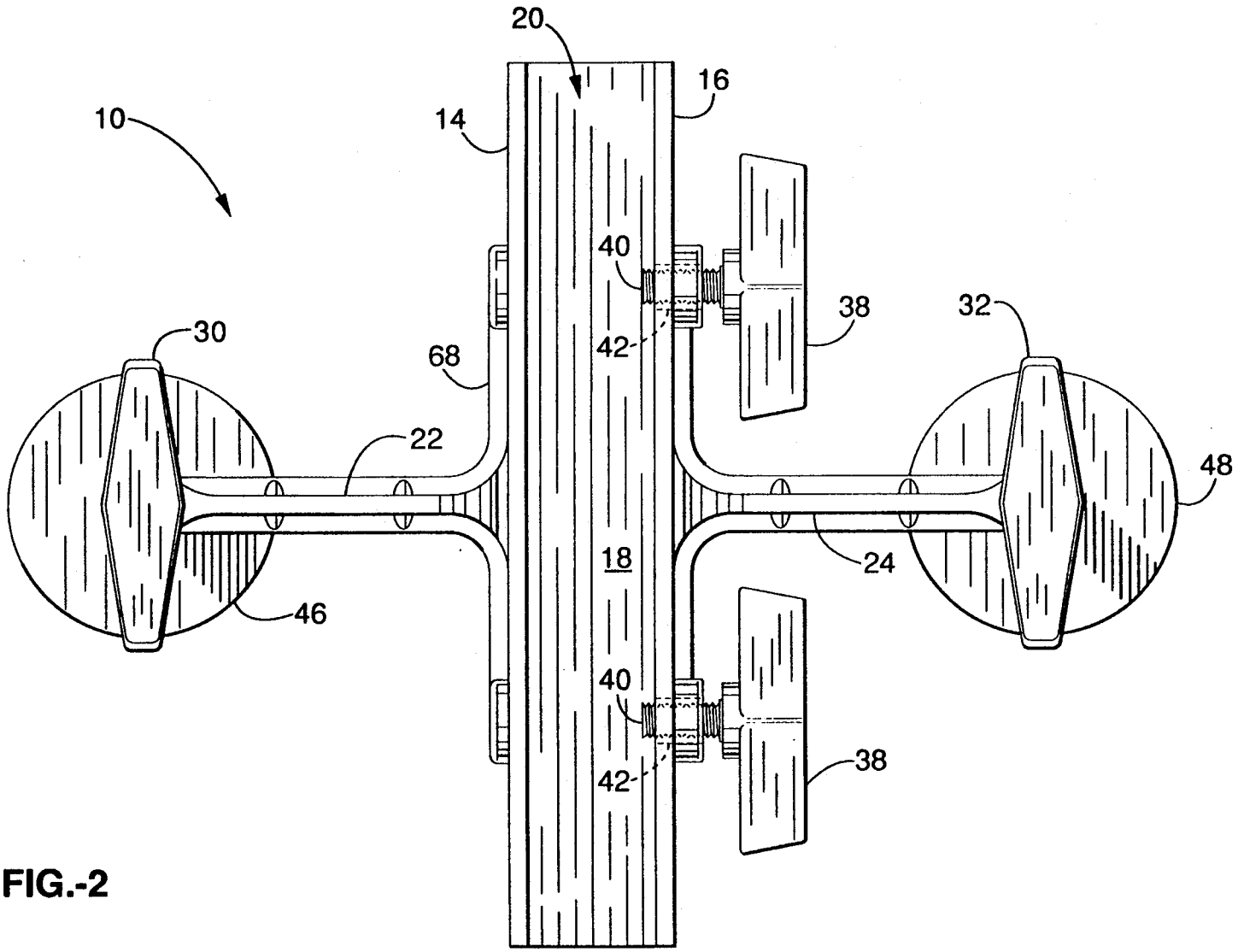
FIG. 2 is a top plan view of the mechanism shown in FIG. 1.

As can be seen in FIG. 2, at least one of the side walls 14, 16 includes a plurality of internally threaded bushings 42 which provide an opening into channel 20. Preferably one such bushing is positioned on either side of an arm 22, 24 as shown in FIG. 1 and FIG. 2 so abutting ends of two screed rails can be placed in channel 20 and locked into position. Bolts 40 rotatably engage bushings 42 and are capable of extending into channel 20. The ends of bolts 40 are drilled and, once installed in bushings 42, are flared to prevent their removal. Side walls 14, 16 could include integral threads, but bushings are preferred to ensure smooth rotation and provide strength for locking screed rails into place. Handles 38 are connected to one end of bolts 40 to aid in rotation thereof. When a screed rail is placed into channel 20, bolts 40 are rotated until one end engages the screed rail and locks it into place. This increases stability of the apparatus and ensures that the screed rails will not slip out of channel 20.

As a further measure to ensure that a screed rail will not slide out of channel 20, side walls 14, 16 are made resilient and converge near the open top of channel 20 by approximately two degrees from vertical. When a screed rail is inserted into channel 20, side walls 14, 16 are spread open and frictionally engage the screed rail.

Referring to FIG. 1 and FIG. 2, arms 22, 24 are strengthened to prevent flexing by use of horizontal arm ribs 62 and vertical arm ribs 64 which are preferably placed on both sides of the arms. Saddle 12 is similarly strengthened by use of "U-shaped" saddle ribs 66 and horizontal wall ribs 68. Note that horizontal wall ribs 68 are an extension of horizontal arm ribs 62. Preferably, these ribs are integrally molded as part of the saddle and arm assembly described herein.

Figure 4:
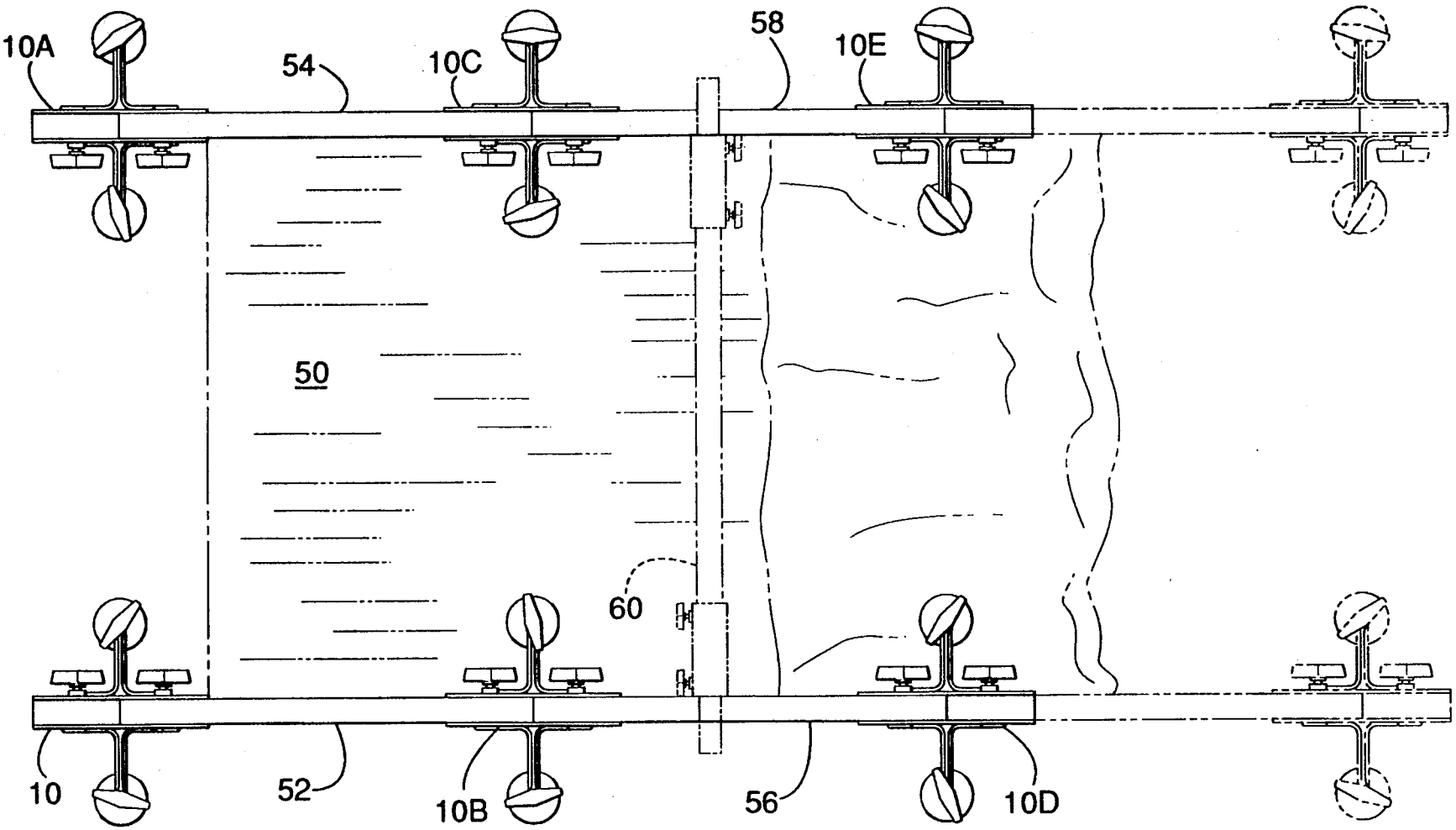
FIG. 4 is a schematic, top plan view showing a plurality of screed rails and a number of the mechanisms shown in FIG. 1 coupled with the screed rails for supporting the screed rails in a pattern in which the screed rails are used for forming a concrete slab.

Referring to FIG. 4, in operation it may be seen that a plurality of screed rail support mechanisms 10, 10A, 10B and 10C are placed in the approximate four corners of a poured slab of concrete 50. Screed rails 52, 54 are then used to support screed 60. A transit sight or laser may be used to set the proper height of screed rails 52, 54 and legs 26, 28 adjusted until the proper height is achieved. Alternatively, a string line which establishes the desired height can be used and the bottoms of arms 22, 24 used as a reference for adjusting legs 26, 28 to the proper height.

Once screed 60 is drawn over the freshly poured concrete of slab 50, it is moved to the section of concrete pour bordered by screed rails 56, 58. Note that the ends of screed rails 56, 58 abut the ends of screed rails 52, 54 and that screed rail support mechanisms 10B and 10C each supports the ends of two screed rails. After the section of concrete bordered by screed rails 56, 58 is poured and levelled, screed rails 52, 54 are removed with screed rail support mechanisms 10 and 10A still attached and relocated such that the free end of screed rail 52 rests in screed rail support mechanism 10D, and the free end of screed rail 54 rests in screed rail support mechanism 10E. This permits the screed rail support mechanisms and screed rails to be re-used in a leapfrog manner for pouring and leveling large areas of concrete.

The preferred material from which the screed rail support mechanism of the present invention is fabricated is plastic, but could be any other material will not warp, will not float, is durable and lightweight, and which resists adherence of concrete. The bushing material used throughout is preferably metal, nylon or similar materials which resist adherence of concrete and will not rust.

Accordingly, it will be seen that this invention provides a unique mechanism for supporting a concrete screed rail, and renders obsolete and replaces all other manual screed accessories, screw stakes, wire chairs, pointed stakes, and base plates. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A screed rail support apparatus, comprising:

(a) a saddle, said saddle including a bottom wall, said saddle including a pair of opposing side walls, said side walls being positioned substantially perpendicular to said bottom wall to form a channel with open ends, an open top and an inside bottom surface, at least one of said side walls including a plurality of threaded openings;

(b) a plurality of threaded bolts, said threaded bolts engaging threads in said threaded openings, said threaded openings adapted for projection of said bolts into said channel;

(c) means for adjusting the degree of projection of said threaded bolts into said channel;

(d) a pair of arms, each said arm having a proximal end, a distal end, and a bottom, each of said arms connected at its proximal end to an opposing side wall and extending outwardly therefrom, the bottom of said arms being aligned with the inside bottom surface of said channel whereby the bottom of said arms establishes the finish elevation of concrete to be poured;

(e) a pair of legs, said legs connected to the distal end of said arms;

(f) means for adjusting the length of said legs between said arms and a supporting surface; and (g) means for locking the position of said legs once their length is adjusted.

2. The apparatus recited in claim 1, further comprising a pad, said pad for placement between said leg and said supporting surface.

3. The apparatus recited in claim 2, wherein said pad is detachable.

4. The apparatus recited in claim 1, wherein said means for adjusting the degree of projection of said threaded bolts into said channel comprises handles connected to said threaded bolts.

5. The apparatus recited in claim 1, wherein said means for adjusting the length of said legs comprises:

(a) a threaded portion on each said leg; and (b) a threaded opening in each of said arms, said threaded portion of said legs engaging said threaded openings.

6. The apparatus recited in claim 5, further comprising handle means connected to the ends of said legs for aiding the turning of said legs.

7. The apparatus recited in claim 6, wherein said means for locking the position of said legs comprises threaded handles, said threaded handles engaging said threaded portion of said legs, said threaded handles rotatable about said legs to engage said arms.

8. The apparatus recited in claim 1, wherein said side walls are resilient, said side walls converging near said open to of said channel.

9. The apparatus recited in claim 1, wherein each said leg comprises an encapsulated rod member.

10. The apparatus recited in claim 1, further comprising a plurality of reinforcing ribs, said ribs preventing flexing of said arms, said ribs preventing flaring of said side walls.

11. An apparatus for supporting rails for guiding a concrete screed, comprising:

(a) a saddle, said saddle including a bottom wall, said saddle including a pair of resilient opposing side walls, said side walls being positioned substantially perpendicular to said bottom wall to form a channel with open ends, an open top and an inside bottom surface, at least one of said side walls including a plurality of threaded bushings;

(b) a plurality of threaded bolts, said threaded bolts engaging threads in said bushings, said bushings adapted for projection of said bolts into said channel, said bolts including handles at one end thereof;

(c) a pair of arms, each said arm having a proximal end, a distal end, and a bottom, each of said arms connected at its proximal end to an opposing side wall and extending outwardly therefrom;

(d) a pair of threaded legs, said threaded legs engaging bushings connected to the distal ends of said arms, said legs including handles connected at one end thereof, the bottom of said arms being aligned with the inside bottom surface of said channel whereby the bottom of said arms establishes the finish elevation of concrete to be poured; and (e) a pair of threaded locking nuts, said locking nuts engaging said threaded legs, said threaded locking nuts rotatable about said legs to engage said arms.

12. The apparatus recited in claim 11, further comprising a pad, said pad for placement between said leg and a supporting surface.

13. The apparatus recited in claim 12, wherein said pad is detachable.

14. The apparatus recited in claim 13, wherein said side walls are resilient, said side walls converging near said open top of said channel.

15. The apparatus recited in claim 14, wherein each said leg comprises an encapsulated rod member.

16. The apparatus recited in claim 15, further comprising a plurality of reinforcing ribs, said ribs preventing flexing of said arms, said ribs preventing flaring of said side walls.

17. A concrete screed rail support device, comprising:

(a) a saddle, said saddle including a bottom wall, said saddle including a pair of resilient opposing side walls, said side walls being positioned substantially perpendicular to said bottom wall to form a channel with open ends, an open top and an inside bottom surface, said side walls converging near said open top of said channel, at least one of said side walls including a plurality of threaded openings;

(b) a plurality of threaded bolts, said threaded bolts engaging threads in said threaded openings, said threaded openings adapted for projection of said bolts into said channel, said bolts including handles at one end thereof;

(c) a pair of arms, each said arm having a proximal end, a distal end and a bottom, each of said arms connected at its proximal end to an opposing side wall and extending outwardly therefrom, the bottom of said arms being aligned with the inside bottom surface of said channel whereby the bottom of said arms establishes the finish elevation of concrete to be poured;

(d) a pair of threaded legs, said threaded legs engaging threaded receptacles in the distal ends of said arms, said legs including handles connected to one end thereof;

(e) a pair of threaded locking nuts, said locking nuts engaging said threaded legs, said threaded locking nuts rotatable about said legs to engage said arms.

18. The apparatus recited in claim 17, further comprising a pad, said pad for placement between said leg and a supporting surface.

19. The apparatus recited in claim 18, wherein said pad is detachable.

20. The apparatus recited in claim 19, further comprising a plurality of reinforcing ribs, said ribs preventing flexing of said arms, said ribs preventing flaring of said side walls.

* * * * *